US006455823B1

(12) United States Patent
Bulgajewski et al.

(10) Patent No.: US 6,455,823 B1
(45) Date of Patent: Sep. 24, 2002

(54) ELECTRICAL HEATER WITH THERMISTOR

(75) Inventors: Edward Bulgajewski, Genoa, IL (US); Larry L. Sharp, Douglas, MI (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/680,704

(22) Filed: Oct. 6, 2000

(51) Int. Cl.[7] ..... H05B 3/16; H05B 3/10
(52) U.S. Cl. ..... 219/548; 219/543
(58) Field of Search ..... 219/538, 539, 219/541, 543, 548, 549, 552; 338/307, 308, 309, 323, 324, 325, 326, 328, 330

(56) References Cited

U.S. PATENT DOCUMENTS

| | | | | |
|---|---|---|---|---|
| 3,287,684 A | * | 11/1966 | Armbruster, Jr. | 338/211 |
| 3,892,946 A | * | 7/1975 | Rimmi | 219/486 |
| 4,410,790 A | | 10/1983 | Berg et al. | |
| 4,538,051 A | * | 8/1985 | Schreder et al. | 219/457.1 |
| 4,628,187 A | | 12/1986 | Sekiguche et al. | |
| 4,743,741 A | | 5/1988 | Ramus | |
| 4,777,351 A | * | 10/1988 | Batliwall et al. | 219/528 |
| 4,857,711 A | | 8/1989 | Watts | |
| 4,931,627 A | | 6/1990 | Watts | |
| 5,015,824 A | | 5/1991 | Monter et al. | |
| 5,025,136 A | | 6/1991 | Doege et al. | |
| 5,132,840 A | | 7/1992 | Okada et al. | |
| 5,181,006 A | * | 1/1993 | Shafe et al. | 338/22 R |
| 5,187,350 A | | 2/1993 | Tsuchiya | |
| 5,206,482 A | | 4/1993 | Smuckler | |
| 5,354,966 A | | 10/1994 | Sperbeck | |
| 5,418,025 A | | 5/1995 | Harmand et al. | |
| 5,543,601 A | | 8/1996 | Bartug et al. | |
| 5,702,565 A | | 12/1997 | Wu et al. | |
| 5,796,044 A | | 8/1998 | Cobian et al. | |
| 5,824,993 A | | 10/1998 | Chrysochoos et al. | |
| 5,824,994 A | | 10/1998 | Noda et al. | |
| 5,902,505 A | | 5/1999 | Finley | |
| 5,904,874 A | | 5/1999 | Winter | |
| 5,948,297 A | | 9/1999 | Haubner et al. | |

OTHER PUBLICATIONS

U.S. Ser. No. 09/281,090, filed Mar. 29, 1999, pending.

* cited by examiner

*Primary Examiner*—Sang Paik
(74) *Attorney, Agent, or Firm*—Mark W. Croll; Paul F. Donovan

(57) ABSTRACT

An electrical heater having a plurality electrodes disposed adjacently on a substrate in spaced apart relation and interconnected by a thermistor material, for example a positive temperature coefficient material. The electrodes each have at least one end portion and preferably two opposite end portions coupled to corresponding electrical terminal located at a common termination zone on the substrate. A spacing between adjacent electrodes may vary and adjacent electrodes may include interdigitated portions to vary the heat produced on select portions of the substrate.

9 Claims, 2 Drawing Sheets

FIG. 2
| CONNECTION TABLE | | |
|---|---|---|
| V1+ | V1− | LOW SETTING |
| V1+ | V2− | MEDIUM SETTING |
| V2+ | V1−,V3− | HIGH SETTING |
FIG. 3
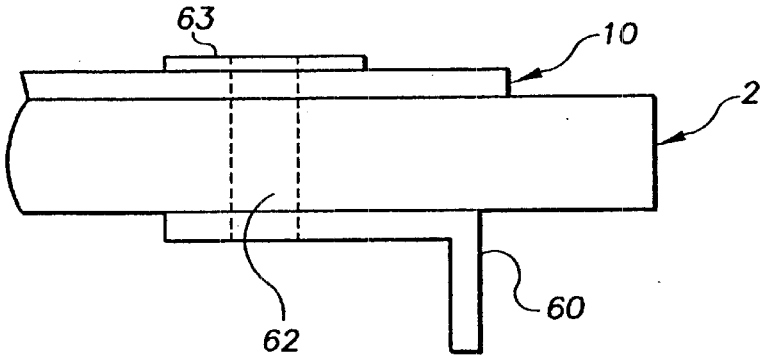
FIG. 4
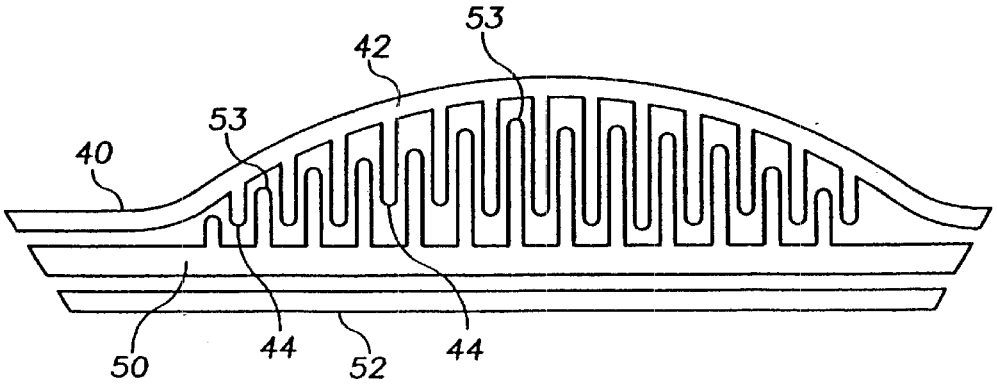

ELECTRICAL HEATER WITH THERMISTOR

BACKGROUND OF THE INVENTION

The invention relates generally to electrical heaters, and more particularly to thermistor controlled heaters, for example those having a positive temperature coefficient material.

Electrical heaters having a thermistor layer interconnecting electrodes disposed on a dielectric material are known generally, as disclosed for example in U.S. Pat. No. 4,857,711 entitled "Positive Temperature Coefficient Heater" and in U.S. Pat. No. 4,931,627 entitled "Positive Temperature Coefficient Heater With Distributed Heating Capability", both of which are assigned commonly with the present application.

An object of the present invention is to provide in some embodiments thereof novel electrical heaters that overcome problems in and improve upon the prior art.

Another object of the invention is to provide in some embodiments thereof novel electrical heaters that are economical and reliable.

A further object of the invention is to provide in some embodiments thereof novel electrical heaters having the capacity for providing more uniformly heated surfaces.

It is also an object of the invention to provide in some embodiments thereof novel electrical heaters having zones with more or less heat.

Another object of the invention is to provide in some embodiments thereof novel electrical heaters having electrodes with opposite end portions located at a common termination zone, for example at a common comer of the heater or along the same side thereof.

Another object of the invention is to provide in some embodiments thereof novel electrical heaters formed on a single substrate.

A further object of the invention is to provide in some embodiments thereof novel electrical heaters having multiple temperature configurations or settings.

A further object of the invention is to provide in some embodiments thereof novel electrical heaters having multiple temperature configurations or settings without complex or costly electrical controls.

Yet another object of the invention is to provide in some embodiments thereof novel positive temperature coefficient electrical heaters having multiple temperature settings controlled by a switch.

Another object of the invention is to provide in some embodiments thereof novel electrical heaters suitable for use in seat heating applications.

A more particular object of the invention is to provide in some embodiments thereof novel electrical heaters comprising first and second electrodes disposed on a substrate in spaced apart relation, adjacent portions of the first and second electrodes having interdigitated electrode portions protruding therefrom, other adjacent portions of the first and second electrodes devoid of interdigitated electrode portions, a thermistor material electrically interconnecting the first and second electrodes, a summation of electrical paths along the first and second electrodes from corresponding electrical power application end portions thereof to adjacent portions of the first and second electrodes is substantially the same.

Another more particular object of the invention is to provide in some embodiments thereof novel electrical heaters comprising first and second electrodes disposed on a substrate in spaced apart relation, the first and second electrodes each having opposite end portions located at a common termination zone on the substrate, adjacent portions of the first and second electrodes having interdigitated electrode portions protruding therefrom, a thermistor material electrically interconnecting the first and second electrodes.

A further more particular object of the invention is to provide in some embodiments thereof novel electrical heaters comprising a plurality of first, second and third electrodes disposed on a substrate in spaced apart relation, the second electrode located between the first and third electrodes, the first, second and third electrodes each having opposite end portions located at a common termination zone of the substrate, a thermistor material electrically interconnecting the first, second and third electrodes.

Yet another more particular object of the invention is to provide in some embodiments thereof novel electrical heaters comprising first and second electrodes disposed on a substrate in spaced apart relation, a spacing between some adjacent portions of the first and second electrodes is different than a spacing between other adjacent portions of the first and second electrodes, a thermistor material electrically interconnecting the first and second electrodes, a summation of electrical paths along the first and second electrodes from corresponding end portions thereof where electrical power is applied to adjacent portions of the first and second electrodes is substantially the same.

These and other objects, aspects, features and advantages of the present invention will become more fully apparent upon careful consideration of the following Detailed Description of the Invention and the accompanying Drawings, which may be disproportionate for ease of understanding, wherein like structure and steps are referenced generally by corresponding numerals and indicators.

BRIEF DESCRIPTION OF THE DRAWINGS

FIG. 2 is a multiple temperature setting connection table for the exemplary heater of FIG. 1.

FIG. 3 is an electrical terminal coupled to a substrate and an electrode formed thereon.

FIG. 4 is a portion of an electrical heater having variable spacing between adjacent electrode portions and interdigitated portions extending therefrom.

DETAILED DESCRIPTION OF THE INVENTION

Figure 1:
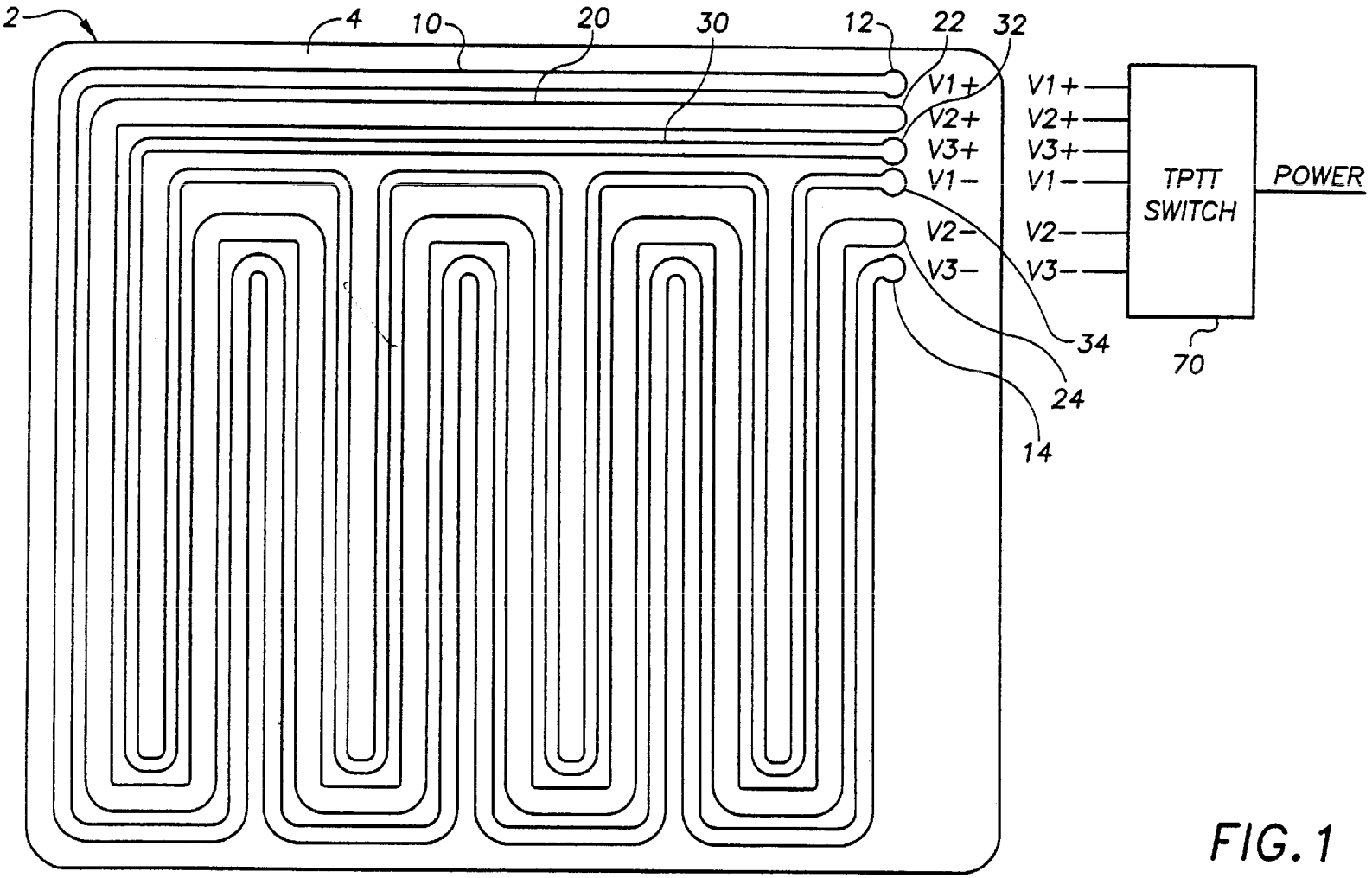
FIG. 1 is an exemplary electrical heater and control switch according to an exemplary embodiment of the present invention.

In the present invention. the electrical heater comprises generally a plurality of at least two, and in the exemplary embodiment of FIG. 1 three, electrodes disposed on a substrate in spaced apart relation. The electrodes are interconnected by a thermistor material.

In one embodiment the substrate is an electrically insulating, or dielectric, material onto which silver or other conductive electrodes are disposed, for example in a screen printing process. In one exemplary embodiment, the thermistor material is a positive temperature coefficient material disposed over the electrodes.

These and other materials suitable for use as the substrate, electrodes and thermistor material in the present invention are known to those having ordinary skill in the art, as disclosed, for example, in the previously referenced U.S. Pat. No. 4,857,711 entitled "Positive Temperature Coefficient Heater" and in U.S. Pat. No. 4,931,627 entitled "Positive Temperature Coefficient Heater With Distributed Heating Capability".

In another embodiment particularly suitable for use in seat heater and related applications, the substrate is a fabric saturated or coated with a positive temperature coefficient material upon which the plurality of electrodes are formed or deposited or otherwise disposed so that the positive temperature coefficient material interconnects the electrodes.

In the exemplary embodiment of FIG. 1, a substrate 2 is coated with a thermistor material 4 having first, second and third electrodes 10, 20 and 30 disposed thereon in spaced apart relation. The plurality of electrodes each have one or more corresponding electrode portions adjacent to electrode portions of one or more of the other electrodes.

The thermistor material 4 provides an electrical connection between the spaced apart electrodes, and particularly the adjacent electrode portions thereof and produces heat according to its particular characteristics when voltage is applied to the electrodes.

The electrodes are also a source of heat, narrower electrodes producing more heat than wider electrodes, but it is generally more efficient to produce heat with the thermistor material rather than with the electrodes. The electrodes are thus configured accordingly.

In some embodiments, the electrodes are configured geometrically to dissipate about the same amount of heat as the thermistor material, thereby providing relatively uniform heating. In other embodiments, however, the electrodes may be configured to produce more or less heat than the thermistor material, depending on the desired heating performance.

In the exemplary embodiment, electrodes 10, 20 and 30 are arranged in a generally rectangular, serpentine pattern, and the adjacent electrode portions thereof are predominately linear and parallel.

In the exemplary embodiment of FIG. 1, the first, second and third electrodes 10, 20 and 30 are substantially continuous strips arranged side by side, with the second electrode 20 disposed between the first and third electrodes 10 and 30. Adjacent portions of the first, second and third electrodes are arranged in a nested serpentine pattern.

In other embodiments, however, the adjacent electrode portions may be curvilinear and the spacing therebetween may vary along the length of the electrodes. In FIG. 4, for example, the electrode 40 has a curved portion 42 wherein a spacing between the curved portion 42 and another adjacent electrode 50 varies.

The electrodes each comprise corresponding opposite electrode end portions, preferably located at a common termination zone of the substrate, for example along a common side or at the same corner of the substrate, to facilitate connection to a power supply.

In the exemplary embodiment, the first electrode 10 has corresponding opposite end portion 12 and 14, the second electrode 20 has corresponding opposite end portions 22 and 24, and the third electrode 30 has corresponding opposite end portions 32 and 34. The opposite end portions of the electrodes are located on the same end or side of the substrate.

In the exemplary embodiment, the first electrode 10 has corresponding opposite end portions 12 and 14, the second electrode 20 has corresponding opposite end portions 22 and 24, and the third electrode 30 has corresponding opposite end portions 32 and 34. The opposite end portions of the electrodes are located on the same end or side of the substrate.

Electrical power, for example from a voltage source, is applied at one of the end portions of at least two of the electrodes to produce heat, as discussed more fully below. The electrical power is preferably applied through electrical terminals connected to corresponding voltage application end portions of the electrodes, for example by a switch.

At least one end portion of each electrode, and preferably both end portions thereof, are coupled to corresponding electrical terminals, which are also preferably fastened to the substrate at the common termination zone, so that power may be applied to either end portion of the electrode, for example by reconfiguring the switch, depending upon the desired heating configuration.

Each of the electrical terminals may, for example, be in the form of a stamped metal member having an electrical connector blade and an eyelet or a grommet or a staple or some other structure electrically connectable to the corresponding electrode.

In the exemplary embodiment of FIG. 3, the electrical terminal comprises a blade 60 fastened to the substrate 2 and electrically coupled to the first electrode 10 by a conducting member 62 extending through the substrate 2 and through the electrode 10 and is fastened thereto by an end portion 63. Various other electrical terminals and connection means may also be employed alternatively. In some embodiments, the terminals may also be soldered to the electrodes.

The electrical heater of FIG. 1 may be configured for operation at different temperatures by appropriate application of electrical power to the end portions of two or more of the electrodes. In FIG. 1, an exemplary switch 70 permits selective application of electrical power to one or the other of the end portions of two or more of the electrodes.

FIG. 2 is a voltage Connection Table for the multiple temperature settings or configurations of the exemplary three electrode heater of FIG. 1. In a low temperature operating mode, a positive voltage V1+ is applied to the first end portion 12 of the first electrode and a negative voltage V1− (preferably having the same magnitude as the voltage V1+) is applied to the end second portion 34 of the third electrode. The heat produced is generally along serpentine path of the first and third electrodes 10 and 30 and in the thermistor material therebetween.

According to this exemplary configuration and mode of operation, a summation of electrical paths along the first and third electrodes from the corresponding end portions 12 and 34 thereof, where the voltages V1+ and V1− are applied, to adjacent portions along the electrodes is substantially the same. In other words, the voltage across the first and third electrodes 10 and 30 is approximately the same anywhere between the opposite ends thereof.

The heat produced or generated by the thermistor material interconnecting the first and third electrodes is substantially the same along the serpentine path between the opposite end portions thereof, provided that the spacing therebetween is the same and that the voltage across the electrodes remains constant along the electrodes, as illustrated in FIG. 1.

In some embodiments, it is desirable to provide areas or zones on the substrate where more or less heat is generated, which may be performed by varying the spacing between adjacent electrode portions and/or by adding interdigitated electrode portions and/or by varying the size of the electrodes, as discussed further below.

In a medium temperature operating mode, the Medium Setting of FIG. 2, a positive voltage V1+ is applied to the first end portion 12 of the first electrode 10 and a negative voltage V2− is applied to the second end portion 24 of the second electrode 20. The heat produced is generally along serpentine path of the first and second electrodes 10 and 20 and in the thermistor material therebetween.

In a high temperature operating mode, the High Setting of FIG. 2, a positive voltage V2+ is applied to the first end portion 22 of the second electrode, and negative voltages V1− and V3− are applied to the second end portions 34 and 14 of the third and first electrodes, respectively. Heat is thus generated by the thermistor material between the first, second and third electrodes and by the electrodes themselves.

The voltages applied to the first, second and third electrodes 10, 20 and 30 of FIG. 1 to obtain the low, medium and high temperature settings may be controlled simply and reliably with the switch 70, without the requirement of costly electronic controls, for example circuitry that controls power supplied to the electrodes by varying voltage and/or current.

In the exemplary embodiment of FIG. 1, the switch 70 is a multi-pole, multi-position switch, for example a TPTT switch, which has three poles and three switch positions. The exemplary multi-pole, multi-position switch permits selection of the particular electrodes and the particular end portions thereof to which the voltages are applied, without the requirement of costly electronic controls. Generally, the number of switch positions and poles required thereof are dependent on the number of electrodes and temperature settings desired. For example, a two temperature setting heater may be controlled with a DPDT switch, that is, one having two poles and two positions.

In other embodiments, other controls or switching schemes may be employed to operate the heater. For example, latching type switches and/or logic circuitry and/or combinations of momentary switches and relays, among other configurations may be used alternatively. The heaters of the present invention may also be controlled by microprocessor based controllers, for example those in processor based automotive electrical systems.

In the exemplary seat heating application, DC voltages supplied from an automotive electrical system are applied to the electrodes. The applied voltages preferably have substantially equal magnitudes. The indicated polarities of the voltages may be reversed.

In embodiments having three or more electrodes, it may be desirable for the intermediate electrodes to have a greater width than the outer electrodes. In the exemplary embodiment of FIG. 1, for example, the second electrode 20 is wider than the first and third electrodes 10 and 30. This configuration allows the intermediate second electrode 20 to better source current to or sink current from (depending on the voltage polarities) both the first and third electrodes when the heater is operating in the High Setting indicated in the voltage Connection Table of FIG. 2.

In the exemplary embodiment of FIG. 4, the spacing between electrodes 40 and electrodes 50 and 52 varies along the lengths thereof. Generally, the smaller the spacing between electrodes, the more heat that is generated by the thermistor material therebetween when voltage is applied to the electrodes. Thus varying the spacing between adjacent portions of the electrodes on the substrate permits controlling the amount of heat produced on the substrate, particularly that produced by the thermistor material disposed therebetween.

Differing amounts of heat may also be generated by providing interdigitated electrode portions protruding from adjacent portions of the electrodes, thus forming areas or zones on the substrate producing more or less heat, depending on the location and density of the interdigitated portions. In FIG. 4, adjacent electrode portions 40 and 52 include a plurality of interdigitated electrode portions 44 and 53 (only some of which are identified with numerals) protruding therefrom.

As discussed above, the electrodes are configured so that a summation of electrical paths along adjacent electrodes, from the corresponding voltage application end portions thereof, to adjacent portions along the interdigitated electrode portions is substantially the same, thus providing substantially the same voltage across the adjacent interdigitated electrode portions along the path of the electrodes.

In some applications, for example automotive seat heating applications, it is desirable to provide greater or lesser amounts of heat on different portions of the seat. These objects may accomplished readily and cost effectively by providing a seat heater, for example the exemplary multi-temperature seat heater of FIG. 1, having electrodes with variable spacing and/or interdigitated electrode portions, illustrated generally FIG. 4.

While the foregoing written description of the invention enables one of ordinary skill to make and use what is considered presently to be the best mode thereof, those of ordinary skill will understand and appreciate the existence of variations, combinations, and equivalents of the specific exemplary embodiments herein. The invention is therefore to be limited not by the exemplary embodiments herein, but by all embodiments within the scope and spirit of the appended claims.

What is claimed is:

1. An electrical heater, comprising:

a substrate;

a plurality of first, second and third electrodes disposed on the substrate in spaced apart relation;

the second electrode located between the first and third electrodes;

the first, second and third electrodes each having opposite end portions located at a common termination zone of the substrate;

a thermistor material electrically interconnecting the first, second and third electrodes;

adjacent portions of the first, second and third electrodes arranged in a generally serpentine pattern on the substrate;

a summation of electrical paths along the first and third electrodes from one of the corresponding end portions thereof to adjacent portions of the first and third electrodes is substantially the same;

a summation of electrical paths along the first and second electrodes from one of the corresponding end portions thereof to adjacent portions of the first and second electrodes is substantially the same; and a summation of electrical paths along the second and third electrodes from one of the corresponding end portions thereof to adjacent portions of the second and third electrodes is substantially the same.

2. The heater of claim 1, the thermistor material comprises a positive temperature coefficient material.

3. The heater of claim 1, a multi-pole, multi-position switch electrically coupled to the opposite end portions of the first, second and third electrodes.

4. The heater of claim 1, a plurality of electrical terminals fastened to the substrate at the common termination zone, each of the opposite end portions of the first, second and third electrodes electrically coupled to a corresponding one of the plurality of electrical terminals.

5. The heater of claim 1, the second electrode is wider than the first and third electrodes.

6. The heater of claim 1, adjacent portions of at least two of the first, second and third electrodes having interdigitated electrode portions protruding therefrom.

7. The heater of claim 6, spacing between adjacent portions of at least two of the first, second and third electrodes varies.

8. The heater of claim 1, interdigitated electrode portions protruding from adjacent portions of at least two of the first, second and third electrodes.

9. The heater of claim 1, the substrate is a fabric coated with a positive temperature coefficient material, and the first, second and third electrodes are screen printed thereon.

* * * * *